US005295750A

United States Patent [19]

Tanuma et al.

[11] Patent Number: 5,295,750

[45] Date of Patent: Mar. 22, 1994

[54] WIRE-DOT IMPACT PRINTER

[75] Inventors: Jiro Tanuma; Naoji Akutsu; Takao Uchida; Chihiro Komori, all of Tokyo; Masaru Ito, Fukushima, all of Japan

[73] Assignee: Oki Electric Industry Co., Ltd., Tokyo, Japan

[21] Appl. No.: 15,094

[22] Filed: Feb. 9, 1993

[30] Foreign Application Priority Data

Feb. 13, 1992 [JP] Japan ..... 4-005530[U]

[51] Int. Cl.[5] ..... B41J 9/44

[52] U.S. Cl. ..... 400/124; 400/157.3; 400/166

[58] Field of Search ..... 400/124, 157.2, 157.3, 400/166; 101/93.02, 93.03, 93.05

[56] References Cited

U.S. PATENT DOCUMENTS 4,208,137 6/1980 Liu et al. ..... 400/124
4,940,343 7/1990 Kikuchi et al. .
5,030,020 7/1991 Kikuchi et al. .
5,039,238 8/1991 Kikuchi et al. .
5,071,268 12/1991 Tanuma et al. ..... 400/157.3

*Primary Examiner*—Edgar S. Burr
*Assistant Examiner*—John S. Hilten
*Attorney, Agent, or Firm*—Panitch Schwarze Jacobs & Nadel

[57] ABSTRACT

In a wire-dot impact printer having a capacitance detector for detecting a displacement of each armature by a sensor electrode arranged opposite the armature, a space is formed between each sensor electrode and its associated armature, and a shield pattern is formed with a small space left around each sensor electrode. The shield pattern is fed with a potential at least equal to the potential of each sensor electrode. This makes it possible to reduce the influence of noise upon detection of a capacitance by the capacitance detector. A noise canceling electrode is also disposed around each sensor electrode and is connected to the sensor electrode, whereby a noise canceling circuit is further provided to eliminate noise voltage. The noise canceling circuit can eliminate a noise voltage picked up by the sensor electrode and the noise canceling electrode.

8 Claims, 7 Drawing Sheets

WIRE-DOT IMPACT PRINTER

BACKGROUND OF THE INVENTION

Conventional wire-dot impact printers include those equipped with a capacitance detector which detects a displacement of each armature by a sensor electrode disposed opposite the armature.

Such wire-dot impact printers are disclosed, for example, U.S. Pat. Nos. 4,940,343, 5,030,020 and 5,039,238 commonly assigned to the present assignee. In the wire-dot print head of the wire-dot impact printer disclosed in one of the U.S. patents, i.e., U.S. Pat. No. 4,940,343, an armature is normally attracted toward a core by a magnetic flux produced by a permanent magnet so that an associated leaf spring is flexed. In use, the magnetic flux is canceled out by a magnetic flux produced by an associated coil, whereby the armature is released to drive a print wire fixed on a free end of the armature. A printed circuit board is provided in opposition to armatures. Sensor electrodes are formed on the printed circuit so that a small space left between the sensor electrodes and their corresponding armatures. A displacement of each armature is therefore observed by a change in capacitance between the armature and its corresponding sensor electrode. Upon printing, the drive time of the wire-dot print head is controlled in accordance with the displacement of the armature.

On the printed circuit board, the sensor electrodes are formed as many as the armatures. Mutually independent signal lines are connected to the sensor electrodes, respectively. Further, a common line is formed around the sensor electrodes on the printed circuit board to prevent occurrence of interference between the adjacent sensors.

The common line formed around the sensor electrodes on the printed circuit board is, however, provided merely to prevent occurrence of interference between the adjacent sensor electrodes and cannot protect the sensor electrodes from other electrical disturbance such as noise. When an insulated area on the printed circuit board is electrostatically charged by frictional contact or the like, the charge of each sensor electrode itself is apparently increased or decreased due to the charge around the sensor electrode. As a result, a change in potential of the sensor electrode is also increased or decreased, thereby making it impossible to achieve accurate detection of the change.

SUMMARY OF THE INVENTION

An object of this invention is to provide a wire-dot impact printer having a wire-dot print head in which sensor electrodes are protected from influence of electrical disturbance to permit accurate detection of a change in potential of each sensor electrode and hence to assure printing under optimal printing force.

In one aspect, the present invention therefore provides a wire-dot impact printer comprising:

a wire-dot print head composed of:

armatures each of which carries a print wire fixed on a free end thereof;

leaf springs supporting thereon the armatures, respectively;

cores arranged opposite the respective armatures;

a permanent magnet for producing a magnetic flux so that each armature is attracted toward the associated core against resilient force of the corresponding leaf spring;

coils wound around the cores, respectively, whereby upon energization, each coil produces a magnetic flux to cancel out the magnetic flux of the permanent magnet so that the corresponding armature is released from the associated core;

sensor electrodes formed on a printed circuit board located opposite the armatures, said sensor electrodes being disposed with intervals between the sensor electrodes and the corresponding armatures; and a shield pattern formed around the sensor electrodes on the printed circuit board;

a capacitance detector for detecting a displacement of each armature by the corresponding sensor electrode located opposite the armature; and means for feeding a potential, which is at least equal to a potential of each sensor electrode, to the shield pattern.

According to the present invention, a displacement of each armature can be observed by the detection of a capacitance between the armature and the associated sensor electrode, thereby making it possible to eliminate variations in drive time of the wire-dot print head. Further, a change in charge at each sensor electrode is a predetermined constant increase so that the resulting change in potential is an increase which is proportional to the change in charge. It is therefore possible to reduce influence of noise upon detection of a capacitance at the capacitance detector.

In another aspect, the present invention also provides a wire-dot impact printer comprising:

a wire-dot print head composed of:

armatures each of which carries a print wire fixed on a free end thereof;

leaf springs supporting thereon the armatures, respectively;

cores arranged opposite the respective armatures;

a permanent magnet for producing a magnetic flux so that each armature is attracted toward the associated core against resilient force of the corresponding leaf spring;

coils wound around the cores, respectively, whereby upon energization, each coil produces a magnetic flux to cancel out the magnetic flux of the permanent magnet so that the corresponding armature is released from the associated core;

sensor electrodes formed on a printed circuit board located opposite the armatures, said sensor electrodes being disposed with intervals between the sensor electrodes and the corresponding armatures; and noise-canceling electrodes arranged around the respective sensor electrodes;

a capacitance detector for detecting a displacement of each armature by the corresponding sensor electrode located opposite the armature; and a noise canceling circuit connected to the sensor electrodes and the noise canceling electrodes to eliminate a noise voltage. Accordingly, a noise voltage picked up by each sensor electrode and the associated noise-canceling electrode can be eliminated by the noise canceling circuit.

DESCRIPTION OF THE PREFERRED EMBODIMENTS

Figure 1:
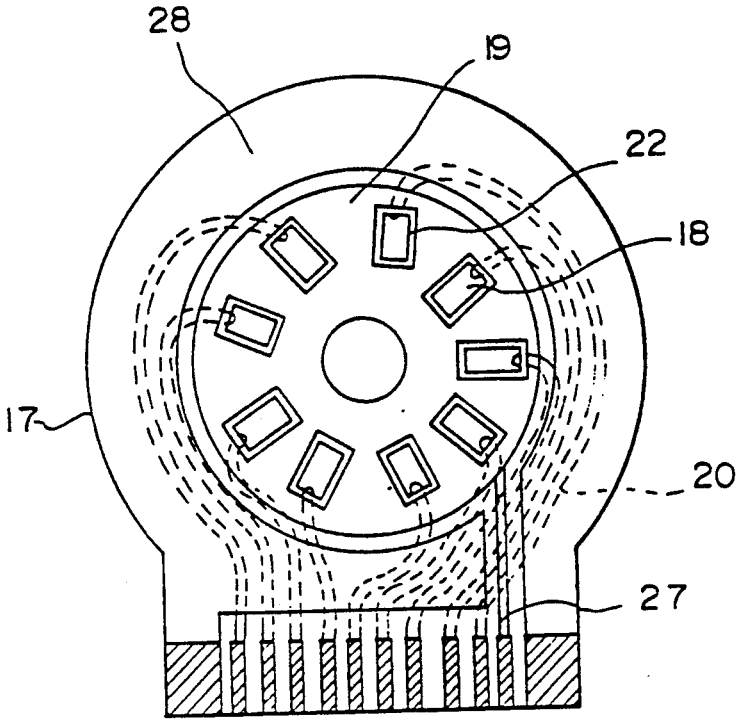
FIG. 1 is a plan view of a printed circuit board in a wire-dot print head in a wire-dot impact printer according to a first embodiment of the present invention.
Figure 2:
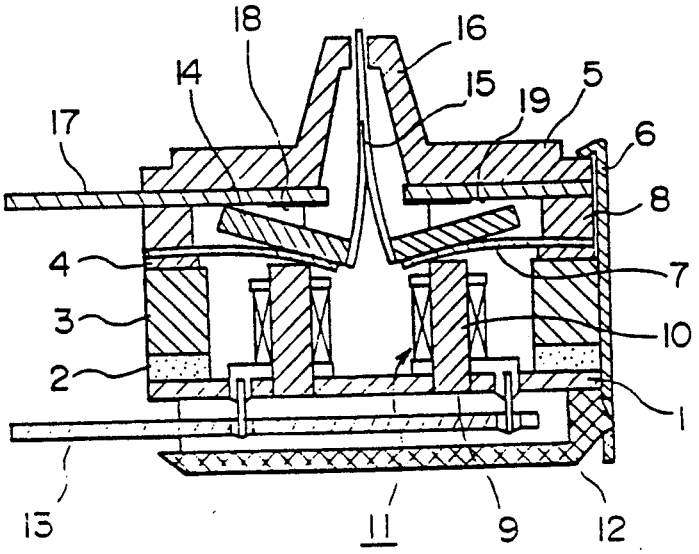
FIG. 2 is a cross-sectional view of the wire-dot print head.
Figure 3:
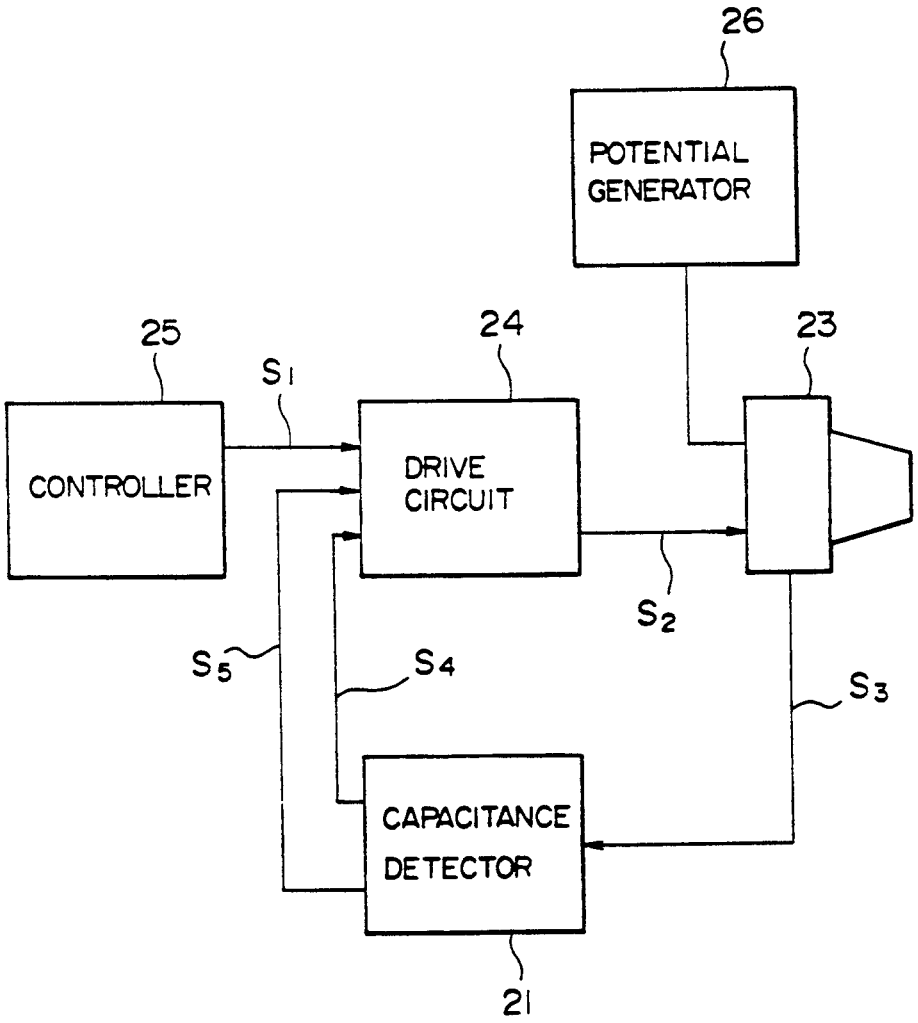
FIG. 3 is a block diagram showing a control system in the wire dot print head.

Referring first to FIG. 1 through FIG. 3, the wire-dot print head in the wire-dot impact printer according to the first embodiment of this invention will hereinafter be described. The wire-dot print head is provided with nine pins by way of example.

In FIG. 2, numeral 1 indicates a base. A permanent magnet 2, an annular upright support 3 and a spacer 4 are stacked successively one over another on an outer peripheral portion of the base 1. Between the spacer 4 and a guide frame 5, leaf springs 7 and a yoke 8 are held by means of a clamp 6. The leaf springs 7 are therefore supported like cantilevers.

Numerals 9 and 10 designate cores 9 disposed on the base 1 and coils 10 wound around outer peripheries of the cores 9, respectively. A solenoid 11 is formed by each core 9 and the associated coil 10. Designated at numeral 12 is a cover protecting a printed circuit card 13 via which wirings extend to the individual coils 10. At a flexible portion of each leaf spring 7, an armature 17 is mounted adjacent the yoke 8. Opposite to the core 9 of each solenoid 11, a print wire 15 is fixed on a free end of the corresponding armature 14. The print wire 15 is guided by a wire guide 16 toward an unillustrated platen.

While the coil 10 is not energized in the wire-dot print head constructed as described above, the associated armature 14 supported on the leaf spring 7 is attracted toward the corresponding core 9 by a magnetic flux of the permanent magnet 2 so that the corresponding print wire 15 is maintained in a position not projecting out from the wire guide 16.

When the coil 10 is energized in the state described above, a magnetic flux is produced to cancel the magnetic flux of the permanent magnet 2. As a consequence, the print wire 15 is caused to project out from an end face of the wire guide 16 under resilient force of the leaf spring 7. The print wire 15 so projected then strongly presses an ink ribbon and a print medium, which are both arranged opposite the wire-dot print head, against the unillustrated platen to perform printing.

If there are variations in flight time among the print wires 15 or in the contact time between the ink ribbon and the print medium, the time required for each print wire 15 to return may differ from that expected so that the armature 14 or the leaf spring 7 may collide the core 9 or the print wire 15 fails to return for a long time. This may result in a poor print.

To cope with such potential problems, it is designed to determine a displacement of each armature 14 so that a drive signal can be generated independently for each print wire 15.

Also illustrated are a printed circuit board 17 disposed between the guide frame 5 and the yoke 8 as well as sensor electrodes 18 provided on the printed circuit board 17. Each sensor electrode 18 is located opposite its corresponding armature 14 with a small space left therebetween, whereby a capacitor having a predetermined capacitance is formed.

The value of the capacitance is governed by the space between the sensor electrode 18 and the associated armature 14. As the armature 14 undergoes a displacement upon printing operation, the capacitance also varies correspondingly. Designated at numeral 19 is a shield pattern formed adjacent each sensor electrode 18.

The shield pattern 19 will next be described in detail with reference to FIG. 1, which illustrates the printed circuit board 17 and the sensor electrodes 18 formed as many as the armatures 14. The sensor electrodes 18 have been formed integrally on the printed circuit board 17 through a pattern. Signal lines 20 extend out independently from the respective sensor electrodes 18 and are connected to a below-described capacitance detector 21 via an unillustrated connector.

The shield pattern 19 is formed without contact to each sensor electrode 18 and, moreover, with a space 22 therebetween, whereby the shield pattern 19 shields the periphery of each sensor electrode 18. The width of the space 22 is at a minimum value which can be achieved in actual fabrication.

Referring now to FIG. 3, there are illustrated the wire dot print head 23, the capacitance detector 21 for detecting a capacitance between each sensor electrode 18 and the associated armature 14, a drive circuit 24 for controlling drive of the wire dot print head 23 in accordance with the capacitance detected by the capacitance detector 21, a controller 25 constructed of a CPU and adapted to control operation of the wire dot print head 23, and a potential generator 26.

Also shown are a print signal $S_1$ outputted from the controller 25 to the drive circuit 24, a drive output signal $S_2$ outputted from the drive circuit 24 to the wire-dot print head 23, and a displacement signal $S_3$ indicating a potential of one of the sensor electrodes 18 of the wire-dot print head 23. At the capacitance detector 21, the displacement signal $S_3$ is converted to a release detection signal $S_4$ and a print detection signal $S_5$ and then inputted to the drive circuit 24.

The shield pattern 1 is connected to the potential generator 26 via a signal line 27 (see FIG. 1) to form a potential at least equal to that of each sensor electrode 18.

A constant positive electric field is therefore formed around each sensor electrode 18. Since the electric field suppresses edge effects, the charge at each sensor electrode 8, said charge being changed when the associated armature 14 undergoes a displacement, increases by a constant quantity. As a result, the displacement signal $S_3$ to be inputted to the capacitance detector 21, in other words, a change in potential of the sensor electrode 18 can be increased. Because the magnitude of noise contained in the above displacement signal $S_3$ is considered to remain at the same level irrespective of the magnitude of the displacement signal $S_3$, the S/N ratio can be increased by as much as the increase in the displacement signal $S_3$. It is therefore possible to prevent malfunction of the capacitance detector 21 by noise.

It is also possible to reduce influence of charge, which is electrostatically accumulated on the printed circuit board 17, and to increase a change in potential of each sensor electrode 18. When the potential generated across the shield pattern 19 is controlled to the same level as that of the sensor electrode 18 to reduce the difference in potential between the shield pattern 19 and the sensor electrode 18, any leakage current can be minimized so that the potential of the sensor electrode 18 is prevented from being dropped.

Since the shield pattern 19 is interposed between a common line 28 and each sensor electrode 18 and the potential of the shield pattern 19 is controlled above the potential generated across the sensor electrode 18, the displacement signal $S_3$ to be inputted to the capacitance detector 21 becomes greater so that influence of noise can ba reduced. Further, a leakage current between the common line 28 and each sensor electrode 18 on the printed circuit board 17 makes it possible to prevent variations of the displacement signal $S_3$.

It is also possible to prevent interference between the adjacent sensor electrodes 18 on the printed circuit board 17.

By protecting the displacement signal $S_3$, which is to be fed to the capacitance detector 21, from electrical disturbance, each displacement of each armature 14 can be detected accurately. Feedback control of the displacement signal $S_3$ to the drive circuit 24 can therefore set an optimal drive time. This makes it possible not only to perform high-speed printing but also to improve the quality of printing.

Figure 4:
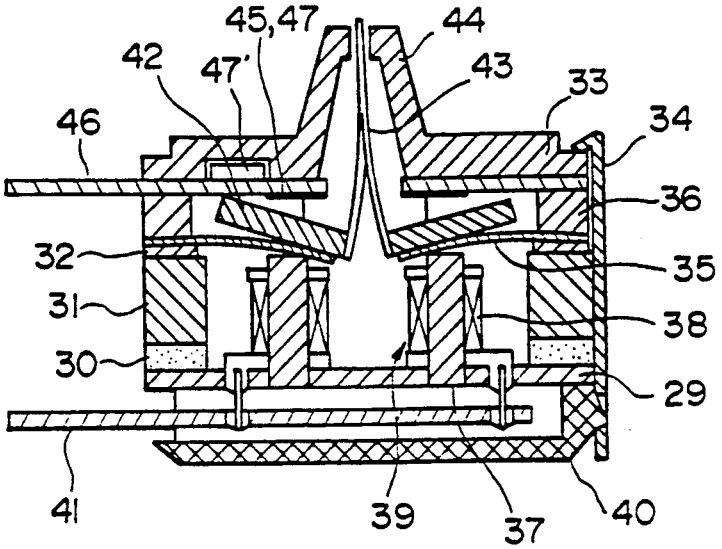
FIG. 4 is a cross-sectional view of a wire-dot print head in a wire-dot impact printer according to a second embodiment of the present invention.

Referring next to FIG. 4 showing the second embodiment of this invention, a description will be made of the wire-dot print head which can improve the S/N ratio of the capacitance detector, said detector being adapted to detect a displacement of each armature by its associated electrode, and hence permits printing under optimal printing force. The wire-dot print head is provided with 24 pins by way of example.

In FIG. 4, numeral 29 indicates a base. A permanent magnet 30, an annular upright support 31 and a spacer 32 are stacked successively one over another on an outer peripheral portion of the base 29. Between the spacer 32 and a guide frame 33, leaf springs 35 and a yoke 36 are held by means of a clamp 34. The leaf springs 35 are therefore supported like cantilevers.

Numerals 37 and 38 designate cores disposed on the base 29 and coils wound around outer peripheries of the cores 37, respectively. A solenoid 39 is formed by each core 37 and the associated coil 38. Designated at numeral 40 is a cover protecting a printed circuit card 41 via which wirings extend to the individual coils 38. At a flexible portion of each leaf spring 35, an armature 42 is mounted adjacent the yoke 36. Opposite to the core 37 of each solenoid 39, a print wire 43 is fixed on a free end of the corresponding armature 42. The print wire 43 is guided by a wire guide 44 toward an unillustrated platen.

Figure 5:
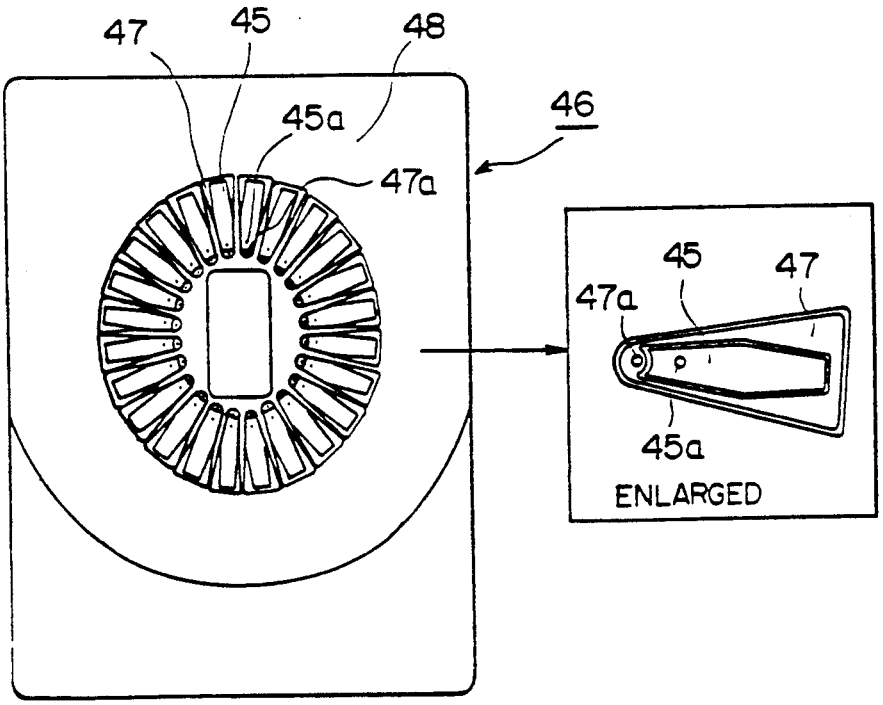
FIG. 5 is a plan view of an electrode side of a printed circuit board in the wire-dot print head of FIG. 4.
Figure 6:
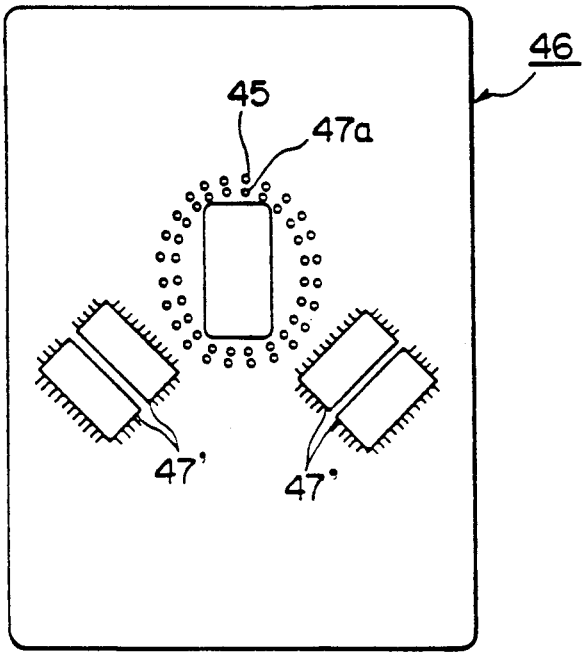
FIG. 6 is a plan view of a mounting side of the printed circuit board in the wire-dot print head of FIG. 4.

Designated at numeral 35 are sensor electrodes which have been formed as many as the armatures 42 on an electrode side of the printed circuit board 46. In addition, a noise canceling circuit 47' is mounted on a mounting side of the printed circuit board 46. The electrode side of the printed circuit board is depicted in FIG. 5, while the mounting side of the printed circuit board is illustrated in FIG. 6. As is shown in FIG. 5, the sensor electrodes 45 are arranged in a radial pattern on the electrode side of the printed circuit board 46 so that the sensor electrodes 45 are located opposite their corresponding armatures 42. As is illustrated in the enlarged sketch, a noise canceling electrode 47 is provided around the periphery of each sensor electrode 45 with a space maintained therebetween. Along the periphery of each noise canceling electrode 47, a shield pattern 48 is also provided to avoid any crosstalk with the adjacent sensor electrodes 45. As is depicted in FIG. 6, the noise canceling circuit 47' is mounted on the mounting side of the printed circuit board 46. The noise canceling circuit 47' is connected through an unillustrated pattern to via holes 45*a*,47*a* which are in turn connected to the respective sensor electrodes 45 and noise canceling electrodes 47 on the electrode side.

Figure 7:
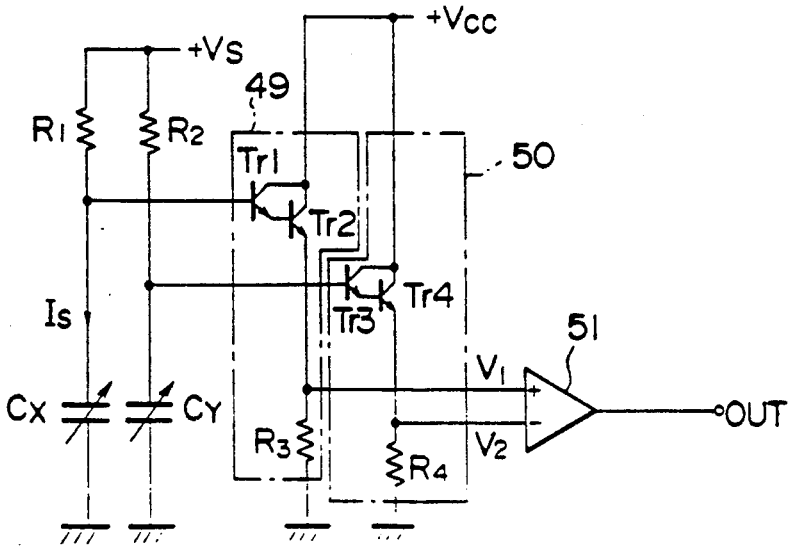
FIG. 7 is a circuit diagram of a noise canceling circuit.

The noise canceling circuit 47' will next be described with reference to FIG. 7. As a result of generation of a noise potential on a surface of one of the armatures 42, the same noise potential also occurs on a surface of the yoke 36 located adjacent the armature 42. Thus, a sensor voltage which involves the noise potential generated on the surface of the armature 42 is picked up by the corresponding sensor electrode 45 and the noise potential on the surface of the yoke 36 is picked up by the associated noise canceling electrode 47. These sensor voltage and noise potential are then inputted to the noise canceling circuit 47' so that the noise voltage is eliminated. Each armature 42 and the associated sensor electrode 45 form a variable capacitor, while the yoke 36 and the associated noise canceling electrode 47 form another variable capacitor. These capacitors are grounded at one ends thereof via the corresponding biasing leaf spring 35 and the yoke 36, respectively. Representing the capacitances of the variable capacitors by Cx,Cy (farad), they are charged from a power supply +Vs (volt) via resistors R1,R2 (ohm), respectively, so that charges Qx,Qy of $(+Vs)\times Cx$ and $(+Vs)\times Cy$ (coulomb) are accumulated.

Lines, which extend between the resistor R1 and the sensor electrode 45 and between the resistor R2 and the noise canceling electrode 47, respectively, are connected as high-impedance circuits to input portions of emitter followers 49,50, respectively. The emitter follower 49 is composed of transistors Tr1,Tr2 and a resistor R3 (ohm). The input portion of the emitter follower 49 is the base of the transistor Tr1. The emitter of the transistor Tr1 is connected to the base of the transistor Tr2. The collectors of the transistors Tr1,Tr2 are both connected to another power supply +Vcc (volt). The power supply +Vcc is set higher than the power supply +Vs. The emitter of the transistor Tr2 is grounded via the resistor R3.

Likewise, the emitter follower 50 is composed of transistors Tr3,Tr4 and a resistor R4 (ohm). An input portion of the emitter follower 50 is the base of the transistor Tr3. The emitter of the transistor Tr3 is connected to the base of the transistor Tr4. The collectors of the transistors Tr3,Tr4 are both connected to the power supply +Vcc. The emitter of the transistor Tr4 is grounded via the resistor R4. Lines, which extend between the transistor Tr2 and the resistor R3 and between the transistor Tr4 and the resistor R4, respectively, are connected as output portions of the emitter followers 49,50 to a non-inverted input terminal and inverted input terminal of a differential amplifier 51, respectively.

A description will next be made of an operation of the wire-dot impact printer according to the second embodiment of this invention. While each coil 38 is not energized, the armature 42 is attracted toward the core 37 by a magnetic flux of the permanent magnet 30 so that the biasing leaf spring 35 is flexed. Upon energization of the coil 38, the coil 38 produces a magnetic flux so that the magnetic flux of the permanent magnet 30 is canceled out. The armature 42 is therefore released from the core 37 toward the sensor electrode 45 by the spring force of the biasing leaf spring 35.

When the coil 38 adjacent to the energized coil 38 is not energized, release of the armature 42 form the core 37 results in a change in distance between the armature 42 and the sensor electrode 45, whereby the capacitance varies. Since its changing rate is expressed by dCx/dt, the changing rate of the charge Qx can be expressed by $dQx/dt=(+Vs)\times dCx/dt$. This is a charging or discharging current Is (ampere). Since the sensor electrode 45 is provided on the side of its terminal with the emitter follower 49 as a high-impedance circuit, a substantial portion of the charging or discharging current Is flows through the resistor R1 so that the voltage at the input terminal of the emitter follow 49 becomes $(+Vs)-R1\times Is$ (volt). As a voltage V1 (volt), the voltage is then inputted from the output terminal of the emitter follower 49 to the non-inverted input terminal of the differential amplifier 51.

Figure 8:
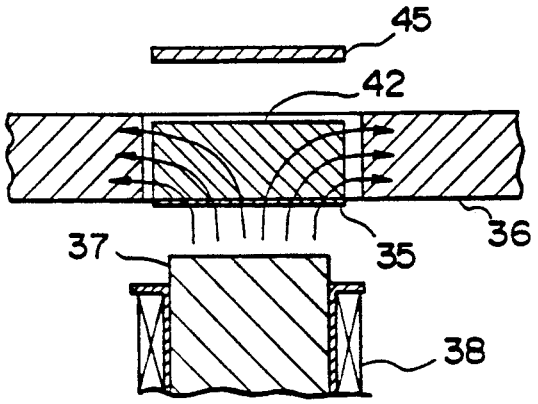
FIG. 8 is a diagram showing the state of a magnetic flux when a core is energized singly.
Figure 9:
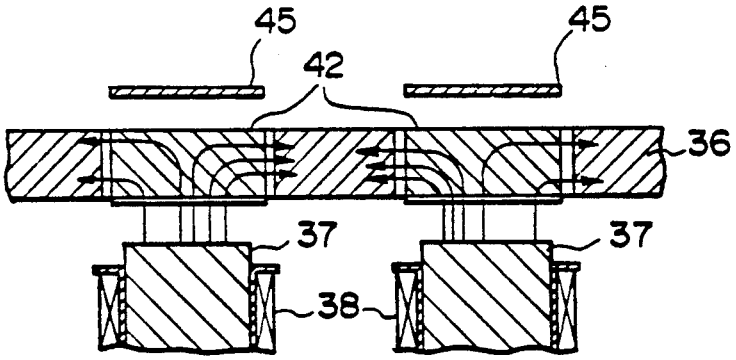
FIG. 9 is a diagram depicting the state of a magnetic flux when adjacent cores are energized at the same time.

At this time, the magnetic flux density of lines of magnetic force which are flowing from the armature 42 toward the yoke 36 is symmetrical as shown in FIG. 8. When the armature 42 is released, a change in the number of lines of magnetic force applied across the magnetic flux also become symmetrical. A potential, which has been generated by electromagnetic induction on the surface of the armature 42, is therefore canceled out so that the sensor electrode 45 does not pick up any noise voltage. The voltage at the input terminal of the emitter follower 50 hence remains substantially zero (volt), so that the voltage is inputted as a voltage V2=zero (volt) from the output terminal of the emitter follower 50 to the inverted input terminal of the differential amplifier 51. As a result, the voltage outputted from the output terminal of the differential amplifier 51 has characteristics as shown in the voltage characteristic diagram of FIG. 10.

Figure 10:
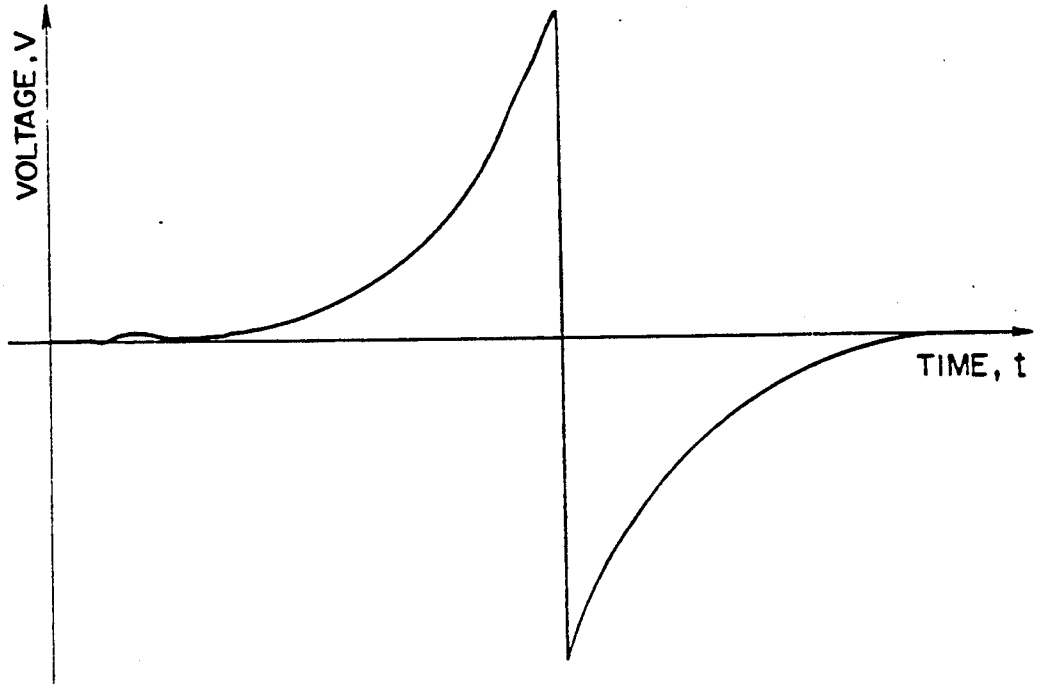
FIG. 10 is a waveform diagram of an output from a differential amplifier.

When the adjacent coil 38 is also energized, on the other hand, the magnetic flux density of lines of magnetic force flowing from the armature 42 toward the yoke 36 is asymmetrical as depicted in FIG. 10. Upon release or attraction of the armature 42, a change in the number of lines of magnetic force applied across the magnetic flux also becomes asymmetrical so that a potential generated by electromagnetic induction on the surface of the armature 42 is not canceled out. The sensor electrode 45 therefore picks up a noise voltage.

Figure 11:
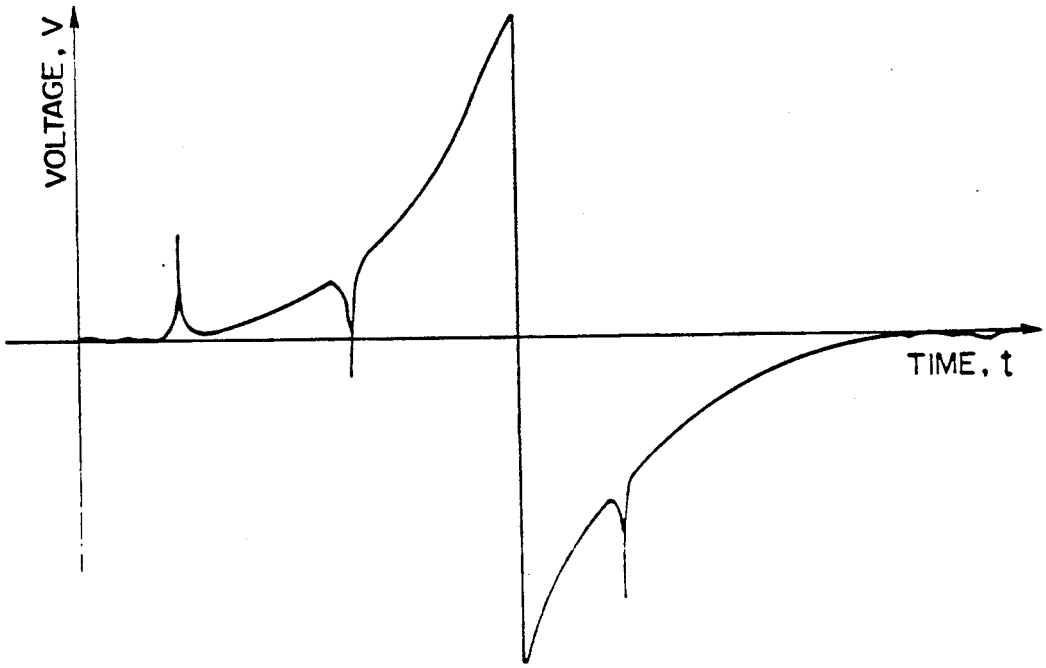
FIG. 11 is a waveform diagram of an input to a non-inverted input terminal of the differential amplifier.

As a consequence, a voltage inputted to the noninverted input terminal of the differential amplifier 51 has characteristics as shown in the voltage characteristic diagram of FIG. 11.

Figure 12:
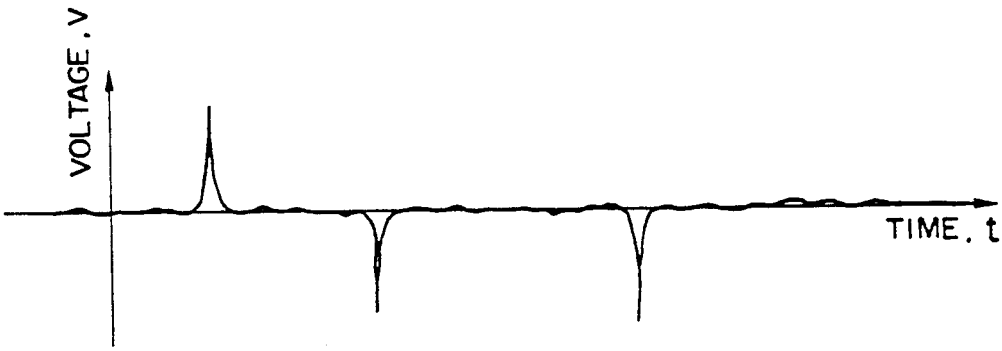
FIG. 12 is a waveform diagram of an input to an inverted input terminal of the differential amplifier.

As a result of the generation of the potential by electromagnetic induction on the surface of the armature 42, the same potential also occurs on the yoke 36 by mutual induction. It is then picked up by the noise canceling electrode 47. Accordingly, the voltage inputted to the inverted input terminal of the differential amplifier 51 has characteristics as shown in the voltage characteristic diagram of FIG. 12. As a result, a voltage outputted from the output terminal of the differential amplifier 51 is free of the noise voltage and has characteristics as illustrated in the voltage characteristic diagram of FIG. 10.

When the adjacent coils on opposite sides of the energized coil are both energized, magnetic fluxes flowing around from the respective adjacent coils are equal to each other so that the balancing of the magnetic flux at the middle coil is maintained. No noise voltage therefore occurs.

As has been described above, a noise voltage picked up by a sensor electrode and its corresponding noise canceling electrode is eliminated by a noise canceling circuit. When an armature crosses a magnetic field whose magnetic flux density is not symmetrical, a potential occurs. This potential then leads to production of noise. The above noise canceling circuit can eliminate such noise so that the S/N ratio of a capacitance detector can be improved. It is therefore possible to construct a wire-dot print head which permits printing under optimal print force.

The provision of a shield pattern around each noise canceling electrode can eliminate occurrence of any crosstalk between adjacent sensor electrodes.

In each embodiment described above, the noise canceling circuit is mounted on the printed circuit board which is in turn fixed on the wire-dot print head. This invention is however not limited to such a design. The noise canceling circuit may be mounted at a position remote from the wire-dot print head.

What is claimed is:

1. A wire-dot impact printer comprising:

a wire-dot print head composed of:

armatures each of which carries a print wire fixed on a free end thereof;

leaf springs supporting thereon the armatures, respectively;

cores arranged opposite the respective armatures;

a permanent magnet arranged to produce a magnetic flux, each armature being attracted by the magnet toward the associated core against a resilient force provided by the corresponding leaf spring;

coils would around the cores, respectively, each coil producing upon energization a magnetic flux to cancel out the magnetic flux of the permanent magnet so that the corresponding armature is released from the associated core;

sensor electrodes formed on a printed circuit board located opposite the armatures, said sensor electrodes being disposed with intervals between the sensor electrodes and the corresponding armatures; and a shield pattern formed around the sensor electrodes on the printed circuit board without contacting the sensor electrodes, the shield pattern shielding each sensor electrode by maintaining a constant positive electric field around each sensor electrode;

a capacitance detector arranged to detect a displacement of each armature by the corresponding sensor electrode located opposite the armature; and means for feeding a potential, which is at least equal to a potential of each sensor electrode, to the shield pattern.

2. A wire-dot impact printer comprising: a wire-dot print head composed of:

armatures each of which carries a print wire fixed on a free end thereof;

leaf springs supporting thereon the armatures, respectively;

cores arranged opposite the respective armatures;

a permanent magnet arranged to produce a magnetic flux, each armature being attracted by the magnet toward the associated core against a resilient force provided by the corresponding leaf spring;

coils wound around the cores, respectively, each coil producing upon energization a magnetic flux to cancel out the magnetic flux of the permanent magnet so that the corresponding armature is released from the associated core;

sensor electrodes formed on a printed circuit board located opposite the armatures, said sensor electrodes being disposed with intervals between the sensor electrodes and the corresponding armatures, each sensor electrode forming a portion of a first variable capacitor; and noise-canceling electrodes, one noise-cancelling electrode arranged around each respective sensor electrode, each noise-cancelling electrode forming a portion of a second variable capacitor;

a first capacitance detector arranged to detect a displacement of each armature by the corresponding sensor electrode located opposite the armature; and a second capacitance detector arranged to detect a noise potential on the armature by the corresponding noise-cancelling electrode.

3. A wire-dot impact printer of claim 2, further comprising a shield pattern formed around the noise canceling electrodes.

4. A wire-dot impact printer of claim 2, further comprising a noise canceling circuit connected to the sensor electrodes and the noise canceling electrodes to eliminate a noise voltage.

5. A wire-dot impact printer of claim 4, wherein the noise canceling circuit is constructed of a high impedance converter and a differential amplifier.

6. A wire-dot impact printer of claim 5, wherein the noise canceling circuit is formed by connecting output portions of the sensor electrodes and those of the noise canceling electrodes to respective input portions of the differential amplifier via the high impedance converter.

7. A wire-dot impact printer of claim 6, wherein the high impedance converter is an emitter follower.

8. A wire-dot impact printer of claim 4, wherein the noise canceling circuit is mounted on the printed circuit board.

* * * * *